US012240584B2

(12) United States Patent
Franz et al.

(10) Patent No.: US 12,240,584 B2
(45) Date of Patent: Mar. 4, 2025

(54) HYDRAULIC STEERING UNIT FOR A BOAT DRIVE AND BOAT DRIVE WITH SUCH A STEERING UNIT

(71) Applicant: HAWE Hydraulik SE, Aschheim (DE)

(72) Inventors: Paul Franz, Lengenwang (DE); Florian Mayr, Pähl-Fischen (DE); Jürgen Osterried, Pfronten (DE); Michael Stegmüller, Marktoberdorf (DE); Markus Weiss, Bertoldshofen (DE)

(73) Assignee: HAWE Hydraulik SE, Aschheim (DE)

( * ) Notice: Subject to any disclaimer, the term of this patent is extended or adjusted under 35 U.S.C. 154(b) by 520 days.

(21) Appl. No.: 17/725,751

(22) Filed: Apr. 21, 2022

(65) Prior Publication Data

US 2022/0340249 A1 Oct. 27, 2022

(30) Foreign Application Priority Data

Apr. 22, 2021 (DE) ..... 102021204032.2

(51) Int. Cl.
*B63H 25/46* (2006.01)

(52) U.S. Cl.
CPC ..... *B63H 25/46* (2013.01)

(58) Field of Classification Search
CPC ..... B63H 25/00; B63H 25/46; B63H 5/125; B62D 5/093; B62D 6/008; B64C 13/00; F15B 7/00; F15B 7/06
(Continued)

(56) References Cited

U.S. PATENT DOCUMENTS 7,179,143 B2 * 2/2007 Mizuguchi ..... B63H 25/00 440/61 S
7,254,945 B1 * 8/2007 Sakai ..... F15B 7/006 60/476
(Continued)

FOREIGN PATENT DOCUMENTS

CN 109139579 A 1/2019
CN 109139580 A 1/2019
(Continued)

OTHER PUBLICATIONS

Japan Office Action dated Feb. 28, 2023; Japan Patent Application No. 2022-064617.
(Continued)

*Primary Examiner* — Lars A Olson
(74) *Attorney, Agent, or Firm* — Dinsmore & Shohl LLP

(57) ABSTRACT

A boat drive hydraulic steering unit has a steering cylinder unit, pump and tank. The cylinder unit has a first chamber, piston and second chamber. The pump is connected to the first and second chambers by respective first and second line. The first chamber is connected to the tank via the first line arrangement when the second chamber is pressurized, by the first line arrangement having a first check valve which opens when the second line arrangement is pressurized. The second chamber is connected to the tank via the second line arrangement when the first chamber is pressurized, by the second line arrangement having a second check valve which opens when the first line arrangement is pressurized. The first and second line arrangements have respective first and second throttling devices acting in the direction of flow towards the tank. A boat drive may include the steering unit.

19 Claims, 5 Drawing Sheets

(58) Field of Classification Search
USPC ..... 440/5, 58, 59, 60, 61 R
See application file for complete search history.

(56) References Cited

U.S. PATENT DOCUMENTS

| | | | |
|---|---|---|---|
| 2007/0199437 | A1 | 8/2007 | Sakai et al. |
| 2012/0214369 | A1 | 8/2012 | Knaack et al. |

FOREIGN PATENT DOCUMENTS

| | | | | |
|---|---|---|---|---|
| DE | 102006010697 | A1 * | 9/2007 | ..... B62D 5/093 |
| EP | 2493756 | B1 | 7/2013 | |
| JP | 2004249793 | A2 | 9/2004 | |
| SU | 443811 | A1 | 9/1974 | |
| WO | 2019/101674 | A1 | 5/2019 | |

OTHER PUBLICATIONS

Throttle check valve. In: Wikipedia, The free Encyclopedia. Last edited: Jan. 30, 2019—15:13 Drosselrückschlagventil. In: Wikipedia, Die freie Enzyklopädie. Bearbeitungsstand: Jan. 30, 2019 um 15:13.

* cited by examiner

HYDRAULIC STEERING UNIT FOR A BOAT DRIVE AND BOAT DRIVE WITH SUCH A STEERING UNIT

CROSS-REFERENCE TO RELATED APPLICATIONS

This application claims priority to German application number 10 2021 204 032.2 filed Apr. 22, 2021, the disclosure of which is hereby incorporated by reference in its entirety.

FIELD OF THE INVENTION

The present invention relates to a hydraulic steering unit for a boat drive and to a boat drive comprising such a hydraulic steering unit. Such hydraulic steering units are used to steer a boat. The steering is performed by at least one hydraulic cylinder acting on the boat drive, which steers the boat drive according to the selected direction of travel. The boat drive can be, for example, an outboard motor or a Z-drive.

BACKGROUND OF THE INVENTION

An according hydraulic steering unit is known from the prior art, for example from EP 2 493 756 B1. Steering units known from the prior art generally have a steering cylinder unit, at least one pump and a tank. The steering cylinder unit has a first piston chamber, a cylinder piston unit and a second piston chamber separated from the first piston chamber by the cylinder piston unit. At least one piston rod is attached to the cylinder piston unit, which deflects the boat drive as desired by applying pressure to the respective piston chamber.

To pressurize the respective piston chamber, the pump is connected to the first piston chamber via a first line arrangement and to the second piston chamber via a second line arrangement. Furthermore, when pressure is applied to the second piston chamber, the first piston chamber is connected to the tank via the first line arrangement in that the first line arrangement has a first check valve that is opened when pressure is applied to the second line arrangement. Accordingly, when the first piston chamber is pressurized, the second piston chamber is connected to the tank via the second line arrangement in that the second line arrangement has a second check valve that is opened when the first line arrangement is pressurized.

One problem with known hydraulic steering units is that when the boat drive 101 is steered, the flow direction FR of the water may exert a force $F_{ext}$ on the boat drive 101, as shown in FIG. 1. In particular, when the boat 100 is moving in the direction of travel BR against the flow direction FR of the water, the force $F_{ext}$ generated by the water acts on the boat drive 101 such that the boat drive 101 moves in the direction of the center position MS. If, for example, a steering movement now takes place by changing the pressurization from the first piston chamber to the second piston chamber (i.e. in the case of a steering movement of deflected boat drive AS in the direction of the center position MS), it may happen under certain circumstances, due to the additional force $F_{ext}$ acting in the steering direction, that the second piston chamber is not filled quickly enough, the cylinder piston unit or the piston rod moves ahead and the dynamic pressure in the second line arrangement is not sufficient to open the first check valve. Therefore, "stuttering" of the check valve can occur because sufficient back pressure builds up in the second line arrangement during momentary closure of the check valve, which briefly opens the check valve but then immediately collapses. Precise steering of the boat is then not possible. To prevent this, it is necessary for the pump output to be adjusted via an appropriate valve arrangement, for example via recirculation valves, as proposed, for example, in WO 2019/101674 A1.

However, a disadvantage of such an arrangement is that it is effective even when no external force $F_{ext}$ is applied to the boat drive 101 in the steering direction. Staying with the example of the flow direction FR of the water, the pump output is also controlled by the valve arrangement when steering from the center position MS of the boat drive 101 in one direction or the other against the force generated by the flow direction FR of the water, cf. FIG. 2. In this case, however, the pressure is sufficient to open the first or second check valve. Therefore, energy is constantly consumed by the valve arrangement, which in turn leads to increased heat generation. In the worst case, this can lead to overheating and thus to failure of the hydraulic steering unit. WO 2019/101674 A1 therefore proposes targeted heat dissipation via suitable means. While this reliably prevents failure due to overheating, it increases the overall cost of the steering unit and does not reduce the overall energy consumption.

It is the object of the present invention to provide a hydraulic steering unit for a boat drive in which the first and second check valves can be safely opened and unnecessary energy consumption and consequent heating of the unit is prevented without the need to provide additional means for heat dissipation.

The solution of the problem is achieved with a hydraulic steering unit as described herein. Preferred embodiments are also described.

SUMMARY OF THE INVENTION

Compared to the prior art, the invention is characterized in particular in that that the first line arrangement has a first throttling device acting in the direction of flow to the tank and that the second line arrangement has a second throttling device acting in the direction of flow to the tank.

The first and second throttling devices have the effect of achieving a volume flow in the direction of flow from the respective piston chamber to the tank that is independent of a possible external force, thus effectively preventing the cylinder piston unit from moving ahead. Consequently, the volume flow is throttled in the event of an externally acting force from the respective piston chamber. Heat generation is also reduced compared with solutions known from the prior art, and the risk of overheating is thus lower. Also, the hydraulic steering unit according to the invention can thus be designed more compactly, which in turn saves costs, material and installation space. At the same time, it can be ensured that the first check valve or the second check valve are reliably opened during a steering movement and also remain opened. This means that there is no "stuttering" of the respective check valve.

Preferably, the first throttling device has a first hydraulic resistor. Preferably, the first hydraulic resistor is a first nozzle. A nozzle is an inexpensive component to achieve the desired function. This allows precise steering of the boat drive from a deflected position towards the center position.

Preferably, the first nozzle is an adjustable nozzle that can be adjusted in the closing direction and the opening control direction. Preferably, a first control line branches off from the second line arrangement and acts on the first nozzle in the opening direction. Preferably, a second control line branches off from the first line arrangement between the first piston chamber and the first nozzle and acts on the first nozzle in the closing direction. In this way, a volumetric flow-dependent nozzle can be provided, so that a stronger throttling of the volumetric flow occurs in particular when the external force acts additionally. On the other hand, the throttling is less when no external force acts additionally, which can further reduce the heating.

Preferably, the second throttling device has a second hydraulic resistor. The second hydraulic resistor is preferably a second nozzle. In this context, it is also preferably if the second nozzle is an adjustable nozzle that can be adjusted in the closing direction and in the opening direction, Preferably, a third control line branches off from the first line arrangement and acts on the second nozzle in the opening direction, and a fourth control line branches off from the second line arrangement between the second piston chamber and the second nozzle and acts on the second nozzle in the closing direction. This results in the advantages described above with regard to the first hydraulic resistor correspondingly also for the second hydraulic resistor.

Alternatively, it may be preferable if the first throttling device has a first pressure valve, a first signal line branching off from the first line arrangement between the first piston chamber and the first pressure valve and acting on the first pressure valve in the opening direction. A second signal line branches off from the first line arrangement between the first pressure valve and the tank and acts on the first pressure valve in the closing direction. A first control line branches off from the second line arrangement and acts on the second pressure valve in the opening direction. This throttling device, which acts in the manner of a load-holding valve, can also be used to throttle the volume flow from the first piston chamber to the tank in such a way that an externally acting force does not cause the cylinder piston unit to move ahead and thus the first check valve can be reliably opened.

In this context, it may be preferable if the second throttling device is constructed accordingly. In particular, the second throttling device therefore has a second pressure valve, a third signal line branching off from the second line arrangement between the second piston chamber and the second pressure valve and acting on the second pressure valve in the opening direction, a fourth signal line branching off from the second line arrangement between the second pressure valve and the tank and acting on the second pressure valve in the closing direction. A third control line branches off from the first line arrangement and acts in the opening direction on the second pressure valve. Overall, this results in an interaction of the first and second throttling devices acting in the manner of a double-acting load-holding valve. This allows for a safe and reliable opening of the first or second check valve.

Preferably, a third hydraulic resistor is disposed in the first control line. A fourth hydraulic resistor is preferably disposed in the third control line. By means of the third or fourth hydraulic resistor, possible vibrations at the corresponding adjustable nozzle or at the corresponding pressure valve can be effectively prevented. Preferably, the third hydraulic resistor and the fourth hydraulic resistor are each a nozzle.

Preferably, the first throttling device has a first bypass line acting in the direction of flow to the first piston chamber, wherein a first bypass check valve is preferably disposed in the first bypass line. In this way, unhindered pressurization of the first line arrangement can take place.

It is advantageous if the second throttle control device has a second bypass line acting in the direction of flow to the second piston chamber, wherein a second bypass check valve is preferably disposed in the second bypass line. In this way, unhindered pressurization of the second line arrangement can take place.

Preferably, the steering cylinder unit comprises a synchronized cylinder. This enables a steering movement in both directions at the same speed. Alternatively or additionally, the steering cylinder unit can also have several coupled cylinders. In this case, it is particularly advantageous if the cylinders are mechanically coupled via the cylinder piston unit.

Preferably, the hydraulic steering unit also has a selector valve that connects the first line arrangement and the second line arrangement selectively to the tank. It is conceivable that the selector valve is pressure-controlled so that the respective line arrangement is always connected to the tank due to the pressurization of the other line arrangement. Preferably, the pump is a reversible pump.

Furthermore, the solution of the problem is achieved with a boat drive as disclosed herein. According to the invention, the boat drive comprises a hydraulic steering unit as described above. The boat drive can in particular be an outboard motor or a Z-drive.

BRIEF DESCRIPTION OF THE DRAWINGS

In the following, the invention is explained in more detail with reference to exemplary embodiments shown in the figures. The figures show schematically.

DETAILED DESCRIPTION OF THE INVENTION

Figure 1:
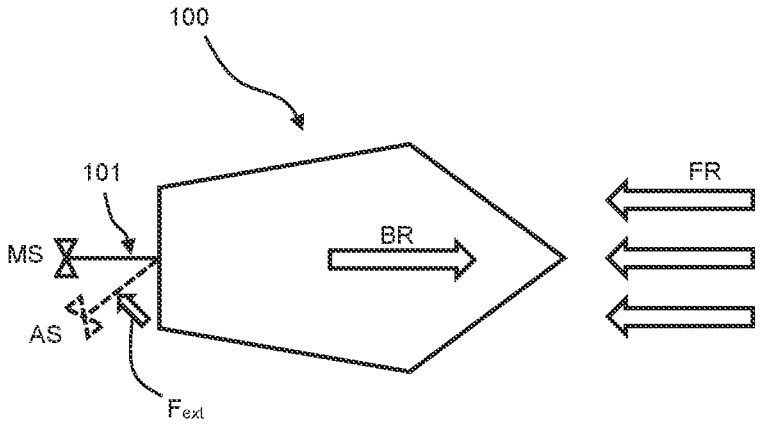
FIG. 1 a boat with a boat drive in a first steering situation.
Figure 2:
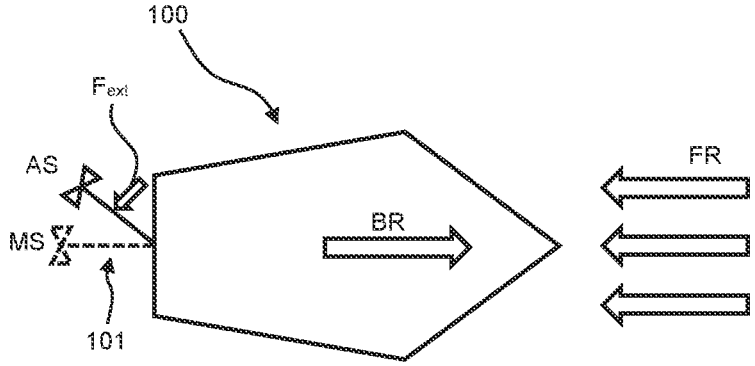
FIG. 2 the boat according to FIG. 1 in a second steering situation.

FIGS. 1 and 2 schematically show a boat 100 with a boat drive 101, for example a Z-drive or an outboard motor. The boat 100 is in particular a leisure boat or sport boat. In the situation shown, the boat 100 travels in the direction of travel BR against the direction of flow FR of the water. For steering the boat 100, the boat drive 101 has a hydraulic steering unit 1*a*-1*d*, which is explained in more detail below with reference to FIG. 3 and FIG. 4.

In the steering situation shown in FIG. 1, the boat drive 101 is to be moved from the deflected position AS shown in dashed lines to the middle position MS. Here, an additional external force $F_{ext}$ generated by the flow direction FR of the water acts on the boat drive 101 in the direction of the middle position MS. As shown in FIG. 2, an external force $F_{ext}$ due to the flow direction FR of the water also acts on the boat drive 101 when the boat drive 101 is steered from the center position MS to a deflected position AS. As explained above, this external force $F_{ext}$ can cause problems when using a conventional hydraulic steering unit.

With the hydraulic steering units 1*a*-1*d* shown as hydraulic circuit diagrams in FIGS. 3 to 6 according to the invention, such problems can be prevented.

Figure 3:
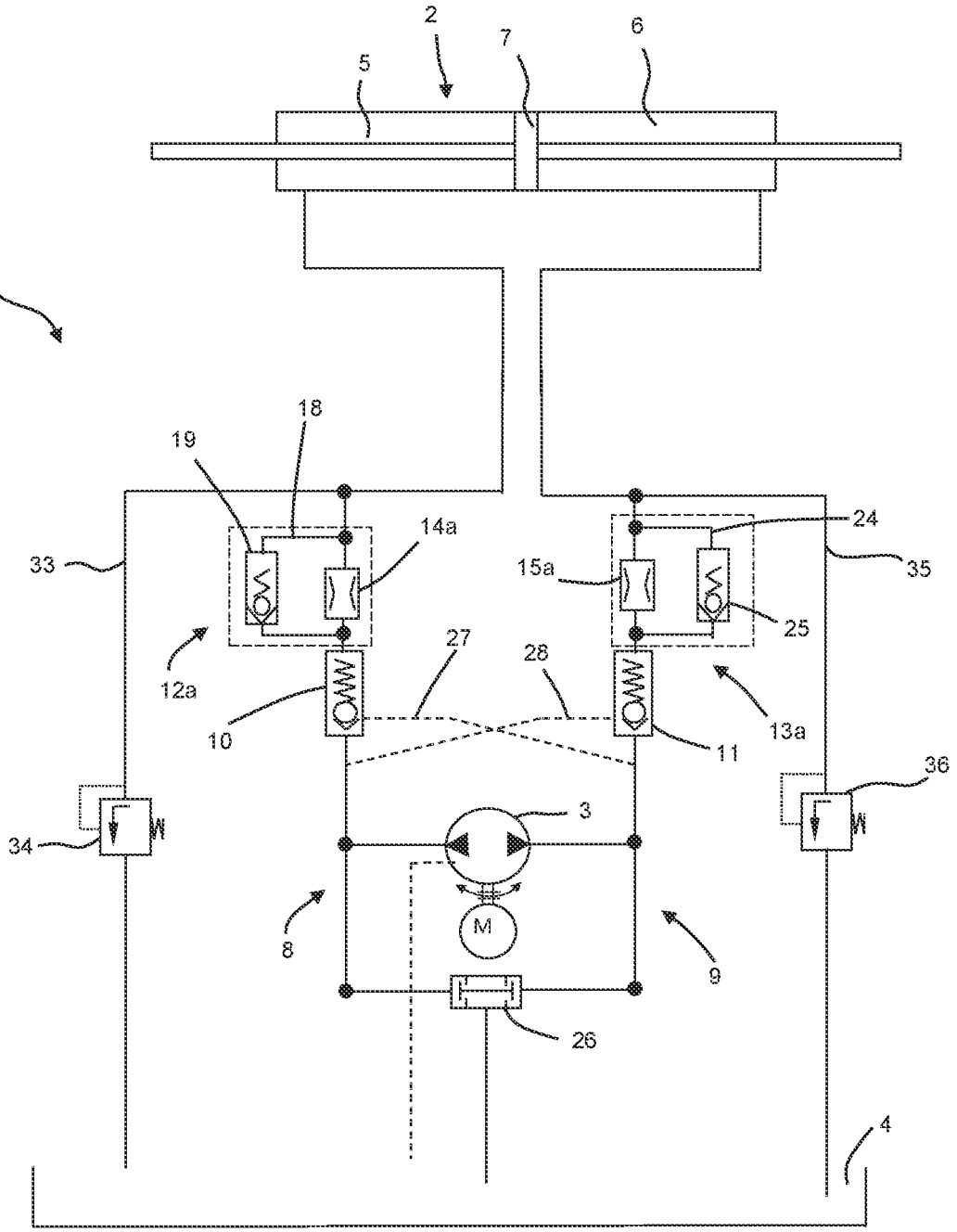
FIG. 3 a hydraulic circuit diagram of an inventive hydraulic steering unit in accordance with a first embodiment.

As shown in FIG. 3, the hydraulic steering unit 1*a* according to the first embodiment has a steering cylinder unit 2 configured as a synchronized cylinder with a first piston chamber 5 and a second piston chamber 6. The first piston chamber 5 is separated from the second piston chamber 6 by a cylinder piston unit configured as a single cylinder piston 7. As can be seen from FIG. 3, the cylinder piston 7 has two piston rods extending in opposite directions from the steering cylinder unit 2. For pressurizing the first piston chamber 5 and the second piston chamber 6 and thus for moving the cylinder piston 7 (and thus for moving the boat drive 101 relative to the hull of the boat 100 by means of the piston rods), the steering unit 1 further comprises a reversible pump 3 and a tank 4.

The pump 3 is driven by a motor M and is connected to the first piston chamber 5 via a first line arrangement 8. The pump 3 is connected to the second piston chamber 6 via a second line arrangement 9. A controllable first check valve 10 and a first throttling device 12*a* are dispsoed in the first line arrangement 8. The first check valve 10 is connected to the second line arrangement 9 via a first opening line 27 in such a way that pressurization of the second line arrangement 9 hydraulically opens the first check valve 10. Accordingly, a controllable second check valve 11, which is connected to the first line arrangement 8 via a second control line 28, and a second throttling device 13*a* are arranged in the second line arrangement 9. Thus, the second check valve 11 is hydraulically opened when pressure is applied to the first line arrangement 8.

The pump 3 as well as the first line arrangement 8 and the second line arrangement 9 are connected to the tank 4 via a pressure-controlled selector valve 26. Depending on the delivery direction of the pump 3, either the first line arrangement 8 or the second line arrangement 9 can be pressurized.

The first throttling device 12*a* acting in the direction of flow towards the tank 4 is disposed upstream of the first check valve 10, as seen in the direction of flow towards the tank 4, and has a first hydraulic resistor in the form of a first nozzle 14*a*. The first throttling device 12*a* has a first bypass line 18 acting in the direction of flow towards the first piston chamber 5 and having a first bypass check valve 19. In this embodiment, the first bypass check valve 19 is spring-loaded. As shown, the first bypass line 18 bypasses the first nozzle 14*a* when the first line arrangement 8 or the first piston chamber 5 is pressurized.

Accordingly, the second throttling device 13*a* acting in the direction of flow to the tank 4 is disposed upstream of the second check valve 11, as seen in the direction of flow to the tank 4. The second throttling device 13*a* has a second hydraulic resistor in the form of a second nozzle 15*a*. The second throttling device 13*a* has a second bypass line 24 acting in the direction of flow towards the second piston chamber 6 and having a second bypass check valve 25, which is also spring-loaded. As shown, the second bypass line 24 bypasses the second nozzle 20 when pressurizing the second line arrangement 9 or the second piston chamber 6.

A first return line 33 with a first pressure relief valve 34 branches off from the first line arrangement 8 upstream of the first throttling device 12*a*, as seen in the direction of flow to the tank 4. The first return line 33 is connected to the tank 4. Accordingly, a second return line 35 branches off from the second line arrangement 9 upstream of the second throttling device 13*a*, as seen in the direction of flow to the tank 4. The second return line 35 is connected to the tank 4 and has a second pressure relief valve 36.

A steering movement by pressurizing the first piston chamber 5 is now described below.

For this purpose, the pump 3 or the motor M is controlled in such a way that the first line arrangement 8 is pressurized. The selector valve 26 blocks the connection of the first line arrangement 8 to the tank 4 and connects the second line arrangement 9 to the tank 4. The first check valve 10 is opened by the pressure in the first line arrangement 8. At the same time, the pressure in the first line arrangement is signaled to the second check valve 11 via the second control line 28, so that the second check valve 11 is also opened. As soon as the back pressure upstream of the first nozzle 14 is correspondingly high and the spring force of the first bypass check valve 19 is overcome, the first bypass check valve 19 opens and the first nozzle 14*a* is bypassed. Consequently, the first piston chamber 5 is pressurized. Any excess pressure generated by the pump 3 can be relieved via the first return line 33 and the first pressure relief valve 34. The cylinder piston 7 moves in the direction of the second piston chamber 6 and forces hydraulic fluid out of the second piston chamber 6 into the second line arrangement 9. At the same time, the desired steering movement of the boat drive 101 is effected by the movement of the cylinder piston 7.

The second check valve 25 is closed so that the hydraulic fluid flows via the second nozzle 15*a* in the direction of the tank 4. The second nozzle 15*a* limits the volume flow to a maximum volume flow that is independent of a possible external force $F_{ext}$. Since the second check valve 11 is hydraulically opened, the hydraulic fluid can flow to the pump 3 or to the tank 4. The pump 3 can draw in hydraulic fluid via tank 4 and selector valve 26.

Accordingly, when the second piston chamber 6 is pressurized, the hydraulic fluid forced from the first piston chamber 5 into the first line arrangement 8 flows via the first nozzle 14*a* in the direction of the tank 4, whereby the volume flow is also limited to a maximum value here. Overall, in both steering directions of the boat drive 101, the volume flow is thus limited to a maximum and then constant volume flow and a pressure drop in the line arrangement 8, 9 pressurized by the pump 3 is avoided. In this way, it can be ensured that the first check valve 10 or the second check valve 11 are reliably opened and that the boat 100 can be steered precisely even with an external force $F_{ext}$ acting on the boat drive 101.

Figure 4:
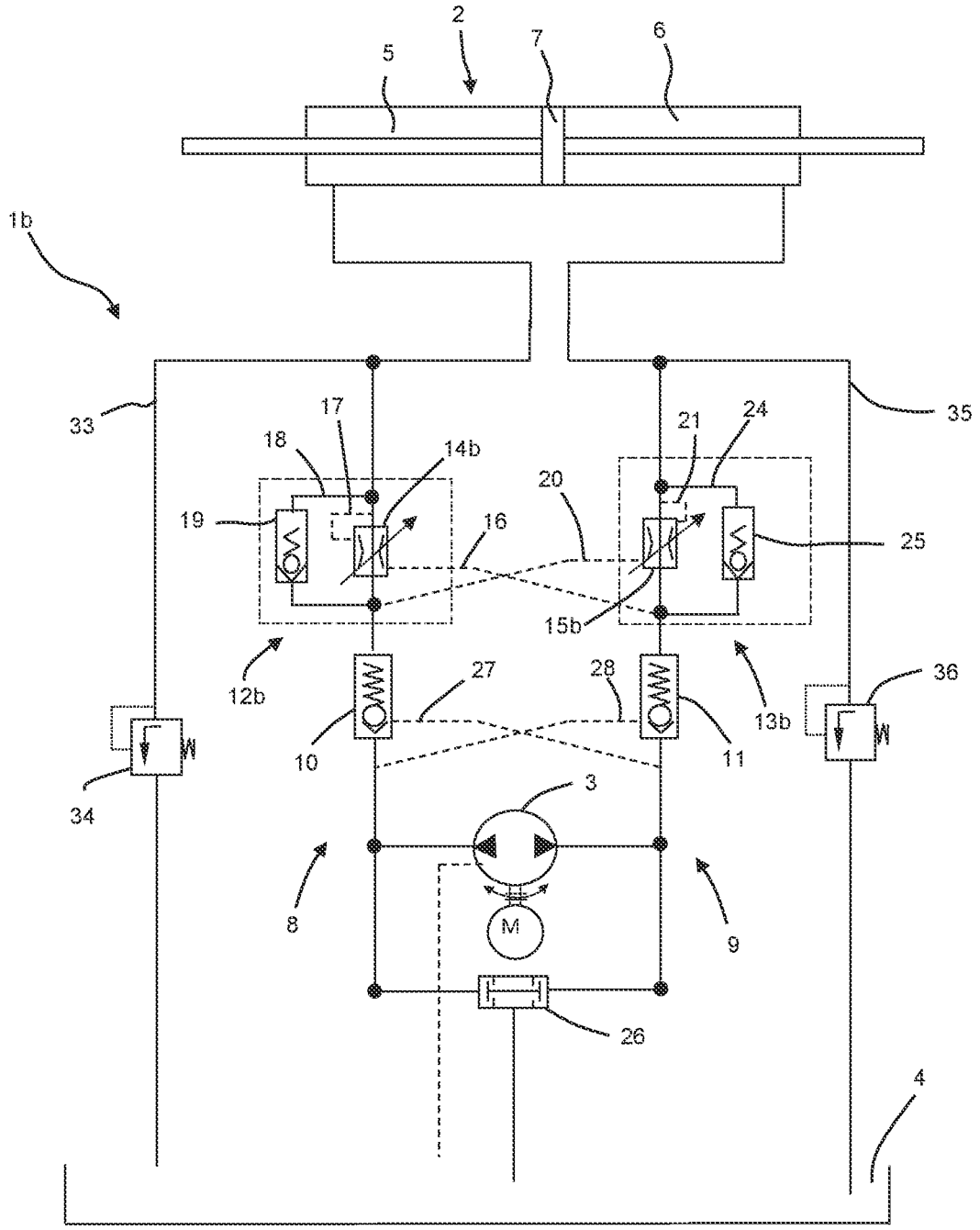
FIG. 4 a hydraulic circuit diagram of an inventive hydraulic steering unit in accordance with a second embodiment.

FIG. 4 shows a hydraulic circuit diagram of a second embodiment of a hydraulic steering unit 1*b* according to the invention. The steering unit 1*b* differs from the steering unit 1*a* shown in FIG. 3 in the configuration of the first throttling device 12*b* and the second throttling device 13*b*. In the following, only the differences are described for simplicity.

As shown, the first throttling device 12*b* has a first hydraulic resistor formed as an adjustable first nozzle 14*b*. The first nozzle 14*b* is adjustable in the opening direction and the closing direction. A first control line 16 branches off from the second line arrangement 9 and acts on the first nozzle 14*b* in the opening direction. In the exemplary embodiment illustrated, the first control line 16 branches off from the second line arrangement 9 downstream of the second check valve 11, as seen in the direction of flow to the second piston chamber 6. A second control line 17 branches off from the first line arrangement 8 between the first piston chamber 5 and the first nozzle 14*b* and acts on the first nozzle 14*b* in the closing direction.

Accordingly, the second throttling device 13*b* has a second hydraulic resistor formed as an adjustable second nozzle

15*b*. The second nozzle 15*b* is also adjustable in the opening direction and the closing direction. A third control line 20 acts on the second nozzle 15*b* in the opening direction, the third control line 20 branching off from the first line arrangement 8 downstream of the first check valve 10, as viewed in the flow direction towards the first piston chamber 5 in this embodiment. A fourth control line 21 branches off from the second line arrangement 9 between the second piston chamber 6 and the second nozzle 15*b* and acts on the second nozzle 15*b* in the closing direction.

When pressure is applied to the first line arrangement 8, the pressure in the first line arrangement 8 is signaled to the second nozzle 15*b* in the closing direction via the third control line 20. Provided that the pressure in the second line arrangement 9 corresponds to the pressure in the first line arrangement 8, the second nozzle 15*b* remains in its preset position, since the pressure in the second line arrangement 9 is signaled in the closing direction to the second nozzle 15*b* via the fourth control line 21. However, insofar as an additional external force acts on the boat drive 101 in the steering direction, the pressure in the second line arrangement 9 increases. Thus, a higher pressure signal is signaled to the second nozzle 15*b* in the closing direction via the fourth control line 21, so that the second nozzle 15*b* throttles the volume flow more strongly overall. In this way, it can be effectively ensured that the second check valve 11 opens reliably and also remains open. Correspondingly, when the second line arrangement 9 is pressurized, it can thus be effectively ensured that the first check valve 10 opens safely and remains open. "Stuttering" of the first check valve 10 or the second check valve 11 is thus prevented.

Figure 5:
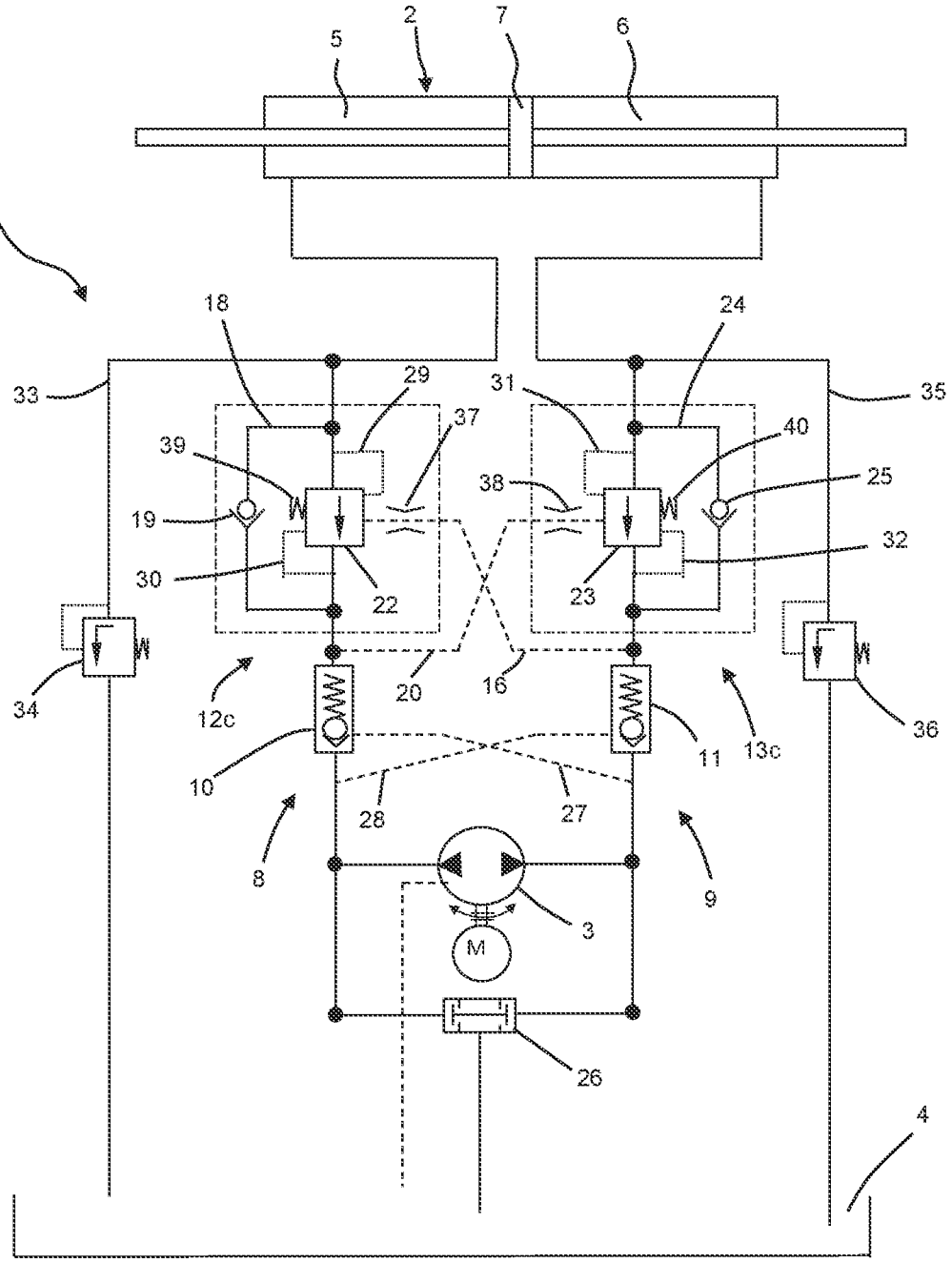
FIG. 5 a hydraulic circuit diagram of an inventive hydraulic steering unit in accordance with a third embodiment.

FIG. 5 shows a hydraulic circuit diagram of a third embodiment of a hydraulic steering unit 1*c* according to the invention. The steering unit 1*c* differs from the steering unit 1*b* shown in FIG. 4 in the configuration of the first throttling device 12*c* and the second throttling device 13*c*. In the following, only the differences are described for simplicity.

The first throttling device 12*c* has a first pressure valve 22, a first signal line 29 and a second signal line 30. The first pressure valve 22 is biased in the closing direction via a first biasing element 39. The first signal line 29 branches off from the first line arrangement 8 between the pressure valve 22 and the first piston chamber 5 and acts on the first pressure valve 22 in the opening direction. The second signal line 30 branches off from the first line arrangement 8 downstream of the first pressure valve 22 between the pressure valve 22 and the tank 4 or the first check valve 10 and acts on the first pressure valve 22 in the closing direction. Furthermore, the pressure signaled via the first control line 16 also acts on the first pressure valve 22 in the opening direction.

Thus, the first throttling device 12*c* acts like a load holding valve in that the pressure in the first control line 16 and the pressure in the first signal line 29 control the first pressure valve 22 against the force of the first spring device 39 and the pressure in the second signal line 30. As soon as the pressure in the first control line 16 drops due to an externally acting force $F_{ext}$, the first pressure valve 22 is closed and thus limits the volume flow to a maximum and constant value.

In addition, a third hydraulic resistor 37 in the form of a nozzle is disposed in the first control line 16. This prevents the first pressure valve 22 from starting to oscillate.

The second throttling device 13*c* is constructed accordingly so that the first throttling device 12*c* and the second throttling device 13*c* act in the manner of a double-acting load-holding valve. For this purpose, the second throttling device 13*c* has a second pressure valve 23, a third signal line 31 and a fourth signal line 32. The third signaling line 31 branches off from the second line arrangement 9 between the second piston chamber 6 and the second pressure valve 23 and, together with the third control line 20, acts in the opening control direction on the second pressure valve 23 against the force of a second biasing element 40. The fourth signaling line 32 branches off from the second line arrangement 9 between the second pressure valve 23 and the tank 4 or the second check valve 11 and, together with the second biasing element 40, acts in the closing control direction on the second pressure valve 23. Furthermore, a fourth hydraulic resistor 38 is arranged in the third control line 20. The operation of the second throttling device 13*c* thus corresponds to the operation of the first throttling device 12*c* described above.

Figure 6:
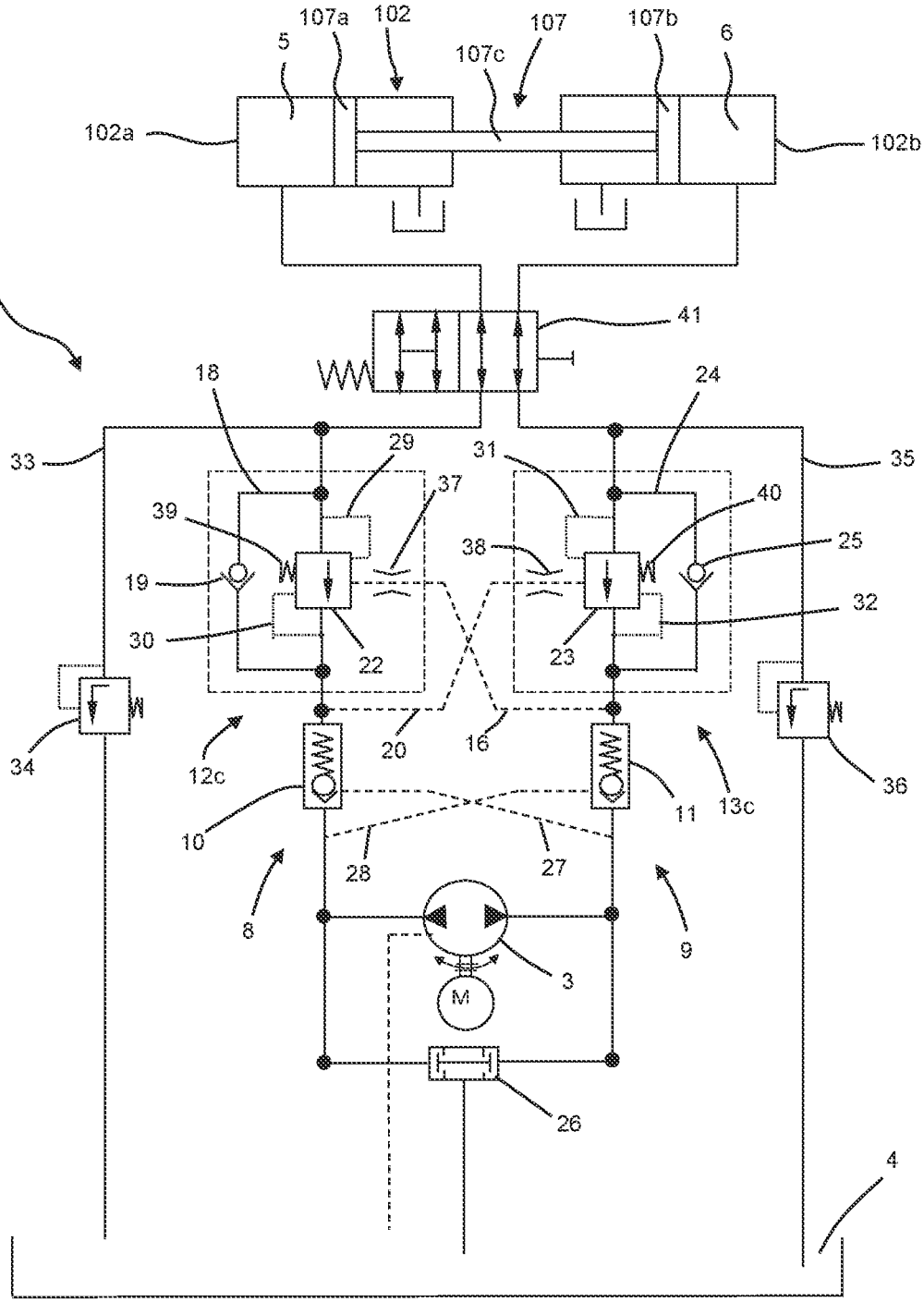
FIG. 6 a hydraulic circuit diagram of an inventive hydraulic steering unit in accordance with a modification of the embodiment shown in FIG. 3.

FIG. 6 shows a hydraulic circuit diagram of a hydraulic steering unit 1*d* according to a fourth embodiment of the invention. The fourth embodiment differs from the third embodiment shown in FIG. 5 only in the configuration and connection of the steering cylinder unit 102.

As shown, the steering cylinder unit 102 according to the fourth embodiment comprises a first cylinder 102*a* and a second cylinder 102*b*, wherein the first cylinder 102*a* and the second cylinder 102*b* are mechanically coupled to each other via the cylinder piston unit 107. For this purpose, the cylinder piston unit 107 comprises a first cylinder piston 107*a* arranged in the first cylinder 102*a*, which thus defines the first piston chamber 5. Further, the cylinder piston unit 107 comprises a second cylinder piston 107*b* arranged in the second cylinder 102*b*, thus defining the second piston chamber 6. The first cylinder piston 107*a* and the second cylinder piston 107*b* are mechanically connected via a common piston rod 107*c*. However, it is also conceivable that the cylinder pistons 107*a*, 107*b* are otherwise coupled, for example hydraulically. There may be air between the cylinders 102*a*, 102*b* as shown. However, it is also conceivable that a separate fluid circuit is formed between the cylinders 102*a*, 102*b*.

Furthermore, the steering unit 1*d* comprises a safety valve 41 which, in the open position shown, connects the first line arrangement 8 to the first piston chamber 5 and the second line arrangement 9 to the second piston chamber 6. The safety valve 41 can, for example, be moved manually into a balancing position in which the first line arrangement 8, the second line arrangement 9, the first piston chamber 5 and the second piston chamber 6 are connected to each other. As a result of this direct pressure equalization, the cylinder piston 7 and consequently the boat drive 101 are brought into a floating position.

Of course, it is also conceivable that the steering cylinder unit 102 and the safety valve 41 are used in the embodiments shown in FIG. 3 and FIG. 4.

The invention claimed is:

1. A hydraulic steering unit for a boat drive, comprising:

at least one steering cylinder unit having a first piston chamber, a cylinder piston unit and a second piston chamber separated from the first piston chamber by the cylinder piston unit;

at least one pump connected to the first piston chamber via a first line arrangement and to the second piston chamber via a second line arrangement;

a tank;

the first piston chamber being connected to the tank via the first line arrangement when the second piston chamber is pressurized, in that the first line arrangement has a first check valve which is opened when the second line arrangement is pressurized; and the second piston chamber being connected to the tank via the second line arrangement when the first piston chamber is pressurized, in that the second line arrangement has a second check valve which is opened when the first line arrangement is pressurized;

wherein:

the first line arrangement has a first throttling device acting in a direction of flow to the tank;

the second line arrangement has a second throttling device acting in a direction of flow to the tank;

the first throttling device comprises a first hydraulic resistor;

the first hydraulic resistor is a first nozzle;

the first nozzle is an adjustable nozzle in a closing direction and an opening direction;

a first control line branches off from the second line arrangement and acts on the first nozzle in the opening direction; and a second control line branches off from the first line arrangement between the first piston chamber and the first nozzle and acts on the first nozzle in the closing direction.

2. The hydraulic steering unit according to claim 1, wherein the second throttling device comprises a second hydraulic resistor.

3. The hydraulic steering unit according to claim 2, wherein the second hydraulic resistor is a second nozzle.

4. The hydraulic steering unit according to claim 3, wherein:

the second nozzle is a nozzle which is adjustable in a closing direction and in an opening direction;

a third control line branches off from the first line arrangement and acts on the second nozzle in the opening direction; and a fourth control line branches off from the second line arrangement between the second piston chamber and the second nozzle and acts on the second nozzle in the closing direction.

5. A hydraulic steering unit for a boat drive, comprising:

at least one steering cylinder unit having a first piston chamber, a cylinder piston unit and a second piston chamber separated from the first piston chamber by the cylinder piston unit;

at least one pump connected to the first piston chamber via a first line arrangement and to the second piston chamber via a second line arrangement;

a tank;

the first piston chamber being connected to the tank via the first line arrangement when the second piston chamber is pressurized, in that the first line arrangement has a first check valve which is opened when the second line arrangement is pressurized; and the second piston chamber being connected to the tank via the second line arrangement when the first piston chamber is pressurized, in that the second line arrangement has a second check valve which is opened when the first line arrangement is pressurized;

wherein:

the first line arrangement has a first throttling device acting in a direction of flow to the tank;

the second line arrangement has a second throttling device acting in a direction of flow to the tank;

the first throttling device comprises a first pressure valve;

a first signal line branches off from the first line arrangement between the first piston chamber and the first pressure valve and acts on the first pressure valve in an opening direction, a second signal line branches off from the first line arrangement between the first pressure valve and the tank and acts on the first pressure valve in a closing direction; and a first control line branches off from the second line arrangement and acts on the first pressure valve in the opening direction.

6. The hydraulic steering unit according to claim 5, wherein:

the second throttling device has a second pressure valve;

a third signal line branches off from the second line arrangement between the second piston chamber and the second pressure valve and acts on the second pressure valve in an opening direction;

a fourth signal line branches off from the second line arrangement between the second pressure valve and the tank and acts on the second pressure valve in a closing direction; and a third control line branches off from the first line arrangement and acts on the second pressure valve in the opening direction.

7. The hydraulic steering unit according to claim 1, wherein:

a third hydraulic resistor is disposed in the first control line; and/or a fourth hydraulic resistor is disposed in the third control line.

8. The hydraulic steering unit according to claim 1, wherein:

the first throttling device has a first bypass line acting in a direction of flow to the first piston chamber.

9. The hydraulic steering unit according to claim 8, wherein a first bypass check valve is disposed in the first bypass line.

10. The hydraulic steering unit according to claim 8, wherein:

the second throttling device has a second bypass line acting in a direction of flow to the second piston chamber.

11. The hydraulic steering unit according to claim 10, wherein a second bypass check valve is disposed in the second bypass line.

12. A boat drive, comprising a hydraulic steering unit according to claim 1.

13. The boat drive of claim 12, wherein the boat drive is an outboard motor or a Z-drive.

14. The hydraulic steering unit according to claim 5, wherein:

the first throttling device has a first bypass line acting in a direction of flow to the first piston chamber.

15. The hydraulic steering unit according to claim 14, wherein a first bypass check valve is disposed in the first bypass line.

16. The hydraulic steering unit according to claim 14, wherein:

the second throttling device has a second bypass line acting in a direction of flow to the second piston chamber.

17. The hydraulic steering unit according to claim 16, wherein a second bypass check valve is disposed in the second bypass line.

18. A boat drive, comprising a hydraulic steering unit according to claim 5.

19. The boat drive of claim 18, wherein the boat drive is an outboard motor or a Z-drive.

* * * * *